US011266243B2

(12) United States Patent
Stravitz et al.

(10) Patent No.: US 11,266,243 B2
(45) Date of Patent: Mar. 8, 2022

(54) FURNITURE HAVING ANTI-TIPPING CONSTRUCTION

(71) Applicant: Dooli Products, LLC, New York, NY (US)

(72) Inventors: David M. Stravitz, New York, NY (US); Steven G. Marton, New York, NY (US)

(73) Assignee: Dooli Products, LLC, New York, NY (US)

( * ) Notice: Subject to any disclaimer, the term of this patent is extended or adjusted under 35 U.S.C. 154(b) by 0 days.

(21) Appl. No.: 17/483,903

(22) Filed: Sep. 24, 2021

(65) Prior Publication Data

US 2022/0007834 A1 Jan. 13, 2022

Related U.S. Application Data

(60) Continuation-in-part of application No. 17/443,615, filed on Jul. 27, 2021, which is a division of (Continued)

(51) Int. Cl.

| | |
|---|---|
| ***A47B 88/00*** | (2017.01) |
| ***A47B 97/00*** | (2006.01) |
| ***A47B 91/12*** | (2006.01) |

(52) U.S. Cl.

CPC ..... *A47B 97/00* (2013.01); *A47B 91/12* (2013.01); *A47B 2097/008* (2013.01)

(58) Field of Classification Search

CPC .... A47B 97/00; A47B 67/04; A47B 2097/008 (Continued)

(56) References Cited

U.S. PATENT DOCUMENTS

| | | | |
|---|---|---|---|
| D22,730 | S | 8/1893 | Shoudy |
| D46,792 | S | 12/1914 | Purcell |

(Continued)

FOREIGN PATENT DOCUMENTS

| | | | |
|---|---|---|---|
| CN | 111955950 | A * | 11/2020 |
| FR | 2620303 | A1 | 3/1989 |

(Continued)

OTHER PUBLICATIONS

No, Dressers Don't Need to be Anchored to a Wall, by John Brownlee, Jul. 13, 206, downloaded Jan. 26, 2020.

(Continued)

*Primary Examiner* — Todd M Epps
(74) *Attorney, Agent, or Firm* — Brian Roffe

(57) ABSTRACT

Piece of furniture, such as a dresser, includes a frame having a front facing surface and a rear facing surface, rectangular drawers each insertable into and partly removable from the frame and at least one of which includes a vertically oriented front panel, rectangular side panels, a horizontal lower panel and a vertically oriented rear panel, and front, non-adjustable supports and rear, non-adjustable supports for supporting the frame on a horizontal surface. The rear supports have a lower height than the front supports. As such, a distance between a lowermost drawer and a rear of the frame is less than a distance between the lowermost drawer and a front of the frame when the lowermost drawer is fully inserted into the frame.

19 Claims, 6 Drawing Sheets

Related U.S. Application Data application No. 17/194,401, filed on Mar. 8, 2021, now Pat. No. 11,103,067, which is a continuation-in-part of application No. 17/094,979, filed on Nov. 11, 2020, now Pat. No. 10,939,761, which is a continuation-in-part of application No. 16/992,397, filed on Aug. 13, 2020, now Pat. No. 10,905,241, which is a continuation of application No. 16/986,932, filed on Aug. 6, 2020, now Pat. No. 10,813,456, which is a continuation-in-part of application No. 16/799,909, filed on Feb. 25, 2020, now Pat. No. 10,758,046, and a continuation-in-part of application No. 16/799,941, filed on Feb. 25, 2020, now Pat. No. 10,786,080.

(60) Provisional application No. 62/949,664, filed on Dec. 18, 2019, provisional application No. 62/944,425, filed on Dec. 6, 2019.

(58) Field of Classification Search
USPC ..... 248/424; 312/330.1, 334.7
See application file for complete search history.

(56) References Cited

U.S. PATENT DOCUMENTS

| | | | | |
|---|---|---|---|---|
| 1,233,775 | A | 7/1917 | Hagar | |
| 1,376,203 | A | 4/1921 | Payne | |
| 1,730,391 | A | 10/1929 | Stobba | |
| 2,104,214 | A | 1/1938 | Vezina | |
| D182,833 | S | 5/1958 | Lubbert et al. | |
| D215,731 | S | 10/1969 | Solie | |
| 4,120,549 | A | 10/1978 | Bureau | |
| D251,885 | S | 5/1979 | Tebbe et al. | |
| 4,214,323 | A | 7/1980 | Thomas | |
| D272,398 | S | 1/1984 | West | |
| D272,497 | S | 2/1984 | Kemp, III et al. | |
| 4,669,695 | A | 6/1987 | Chou | |
| D305,485 | S | 1/1990 | Zalesak | |
| 4,890,813 | A | 1/1990 | Johnson et al. | |
| 5,013,103 | A | 5/1991 | Addison | |
| 5,076,525 | A | 12/1991 | Whipple | |
| 5,174,543 | A | 12/1992 | Corson et al. | |
| D333,578 | S | 3/1993 | White | |
| 5,192,123 | A | 3/1993 | Wallin | |
| D339,938 | S | 10/1993 | Fisher | |
| D347,337 | S | 5/1994 | Keller | |
| 5,352,031 | A | 10/1994 | Nahrgang | |
| 5,431,365 | A | 7/1995 | Hopkins | |
| 5,599,000 | A | 2/1997 | Bennett | |
| D384,525 | S | 10/1997 | McBrayer et al. | |
| 5,794,903 | A | 8/1998 | Peterson, II | |
| D424,833 | S | 5/2000 | Zaidman | |
| 6,068,355 | A | 5/2000 | Thorp | |
| 6,220,562 | B1 | 4/2001 | Konkle | |
| D467,096 | S | 12/2002 | DiCostanzo | |
| 6,508,525 | B2 | 1/2003 | Picogna | |
| 6,533,238 | B2 | 3/2003 | Barnes et al. | |
| D473,401 | S | 4/2003 | de Blois | |
| D503,564 | S | 4/2005 | Juneau et al. | |
| D508,347 | S | 8/2005 | Juneau et al. | |
| D512,903 | S | 12/2005 | Gallien | |
| D514,846 | S | 2/2006 | McDiarmid | |
| D518,975 | S | 4/2006 | Mohundro | |
| 7,185,872 | B2 | 3/2007 | Lowenstein, Jr. | |
| D542,057 | S | 5/2007 | Juneau | |
| 7,232,195 | B2 * | 6/2007 | Yang | A47B 88/57 312/333 |
| 7,287,820 | B2 | 10/2007 | Van Loon et al. | |
| D555,394 | S | 11/2007 | Sexton | |
| D586,147 | S | 2/2009 | Tsay et al. | |
| D599,136 | S | 9/2009 | Jeup | |
| D605,742 | S | 12/2009 | Bock et al. | |
| D606,180 | S | 12/2009 | Bock et al. | |
| D606,634 | S | 12/2009 | Bock et al. | |
| D606,635 | S | 12/2009 | Bock et al. | |
| D611,267 | S | 3/2010 | Collette | |
| D617,117 | S | 6/2010 | Tovin | |
| 7,775,498 | B2 | 8/2010 | Phillips et al. | |
| D625,305 | S | 10/2010 | Bleck et al. | |
| 9,163,842 | B2 | 10/2015 | Adams et al. | |
| 9,578,965 | B2 | 2/2017 | Hamaba et al. | |
| D790,888 | S | 7/2017 | Everson et al. | |
| 9,955,785 | B2 | 5/2018 | Kato | |
| 10,113,687 | B2 | 10/2018 | Wise | |
| 10,321,762 | B2 | 6/2019 | Muskopf | |
| D862,135 | S | 10/2019 | Birch | |
| D867,791 | S | 11/2019 | Birch | |
| 10,524,572 | B2 | 1/2020 | Lercher | |
| 10,758,046 | B1 | 9/2020 | Stravitz et al. | |
| 10,786,080 | B1 | 9/2020 | Stravitz et al. | |
| 10,812,456 | B2 | 10/2020 | Pollet et al. | |
| 10,813,456 | B1 | 10/2020 | Stravitz et al. | |
| 10,905,241 | B1 * | 2/2021 | Stravitz | A47B 91/12 |
| 10,939,761 | B1 | 3/2021 | Stravitz et al. | |
| D932,216 | S * | 10/2021 | Stravitz | D6/670 |
| 2003/0010886 | A1 | 1/2003 | Barnes et al. | |
| 2003/0221593 | A1 | 12/2003 | Usagani | |
| 2006/0207989 | A1 | 9/2006 | Ritchie et al. | |
| 2006/0265806 | A1 | 11/2006 | Stevenson | |
| 2007/0039640 | A1 | 2/2007 | Zheng | |
| 2011/0043088 | A1 | 2/2011 | McConnell et al. | |
| 2013/0087675 | A1 | 4/2013 | Miller | |
| 2014/0263925 | A1 | 9/2014 | Essrig | |
| 2015/0130339 | A1 | 5/2015 | Barnett | |
| 2015/0130342 | A1 | 5/2015 | Barnett | |
| 2017/0021958 | A1 * | 1/2017 | Shelton | A47B 61/00 |
| 2018/0168344 | A1 | 6/2018 | Arrillaga Albeniz | |
| 2018/0209580 | A1 | 7/2018 | Wise | |
| 2019/0150617 | A1 | 5/2019 | Lager et al. | |
| 2019/0365098 | A1 | 12/2019 | Johannesson | |

FOREIGN PATENT DOCUMENTS

| | | | |
|---|---|---|---|
| FR | 2979210 | A1 | 3/2013 |
| JP | 3014942 | U | 8/1995 |
| KR | 200484018 | Y1 | 7/2017 |
| KR | 10194900 | B1 | 2/2018 |
| RU | 2315537 | C2 | 1/2008 |
| WO | 0024293 | A1 | 5/2000 |

OTHER PUBLICATIONS

DE20116637 Zerver; Abstract and figure (2001).
CN209474157 Chang et al.; Abstract and figure (2019).
English translation FR 2620303, 1989.
International Search Report for PCT/US2020/063547 dated Mar. 25, 2021.
Written Opinion for PCT/US2020/063547 dated Mar. 25, 2021.
Gerridan Chest of Drawers from ashleyfurniture.com, retrieved date Jun. 10, 2021, p. 1 from www.ashleyfumiture.com/p/gerridan_chest_of_drawers/B1190-44.html (Year: 2021).

* cited by examiner

FURNITURE HAVING ANTI-TIPPING CONSTRUCTION

CROSS-REFERENCE TO RELATED APPLICATIONS

This application is a continuation-in-part of U.S. patent application Ser. No. 17/443,615 filed Jul. 27, 2021 which is a divisional of U.S. patent application Ser. No. 17/194,401 filed Mar. 8, 2021, now U.S. Pat. No. 11,103,067, which is a continuation-in-part of U.S. patent application Ser. No. 17/094,979 filed Nov. 11, 2020, now U.S. Pat. No. 10,939,761, which is a continuation-in-part of U.S. patent application Ser. No. 16/992,397 filed Aug. 13, 2020, now U.S. Pat. No. 10,905,241, which is a continuation of U.S. patent application Ser. No. 16/986,932 filed Aug. 6, 2020, now U.S. Pat. No. 10,813,456, which is a continuation-in-part of U.S. patent application Ser. No. 16/799,909 filed Feb. 25, 2020, now U.S. Pat. No. 10,758,046, and also a continuation-in-part of U.S. patent application Ser. No. 16/799,941 filed Feb. 25, 2020, now U.S. Pat. No. 10,786,080, and U.S. patent application Ser. No. 16/799,909 claims the benefit under 35 U.S.C. § 119 of U.S. provisional patent application Ser. No. 62/944,425 filed Dec. 6, 2019, now expired, and U.S. provisional patent application Ser. No. 62/949,664 filed Dec. 18, 2019, now expired, all of which are incorporated by reference herein.

This application is also related to, on the grounds that it includes common disclosure as, U.S. patent application Ser. No. 16/935,335 filed Jul. 22, 2020, now U.S. Pat. No. 10,856,659, which is also incorporated by reference herein.

FIELD OF THE INVENTION

The present invention relates to a piece of furniture having an anti-tipping construction, or including or incorporating an anti-tipping mechanism.

BACKGROUND OF THE INVENTION

Furniture tipping accidents and deaths are on the rise. The majority many of toddler furniture pieces, typically dressers, are anywhere from about 16 inches to about 24 inches deep and often toddlers can grab the top of the dresser, grab the top drawer of the dresser and even climb into the bottom drawer of the dresser before the parent is aware of this. Top drawers of these dressers often have heavy contents in them further making the dresser more easy to tip over, which when it occurs, often results in the toddler getting severely hurt, sometimes even rushed to the hospital and even more worrisome, a tragic death.

Many products on the market currently offer the ability to attach the upper back of a piece of furniture, e.g., a dresser, to the wall or other vertical support behind the dresser with a webbing strap or cable so the tipping issue is caught and restricted before the entire dresser falls forward. Yet, this can also allow the topmost dresser drawer to fall forward and still cause accidents. Proper fastening of the dresser to the wall poses yet another issue insofar as it is possible that the screws on the wall or the screws on the dresser are ripped apart when the tipping force is too much, especially if the webbing strap or cable is not attached properly in a safe or secure manner and location. After all, most dresser backs are very cheaply made with the backs often ⅛" thin pressboard or plywood and the frame is typically ⅝"-¾" and made of plywood or even less secure presswood typically used today.

Also, it is possible that the wall mounting was installed without the use of appropriate hardware such as mollies or lead plugs. If that were so, it would take little force for the tipping force exerted by the child or toddler to "rip" a wall-mounting bracket right off the wall thus allowing the dresser to continue its fall. Furthermore, if the frame is presswood, it would not take much force to "rip off" the mounting screws securing the webbing or cable to the frame or back.

In addition to the foregoing problems associated with incorrectly installing furniture safety straps or the fact that the walls and/or furniture cannot always sustain the pressure in view of their construction and fail causing the furniture to tip when a child exerts pressure, it is also a problem that there is a general lack of compliance with provided instructions for installing furniture safety straps. Manufacturers invariably include safety straps or other mechanisms and directions to install such safety mechanisms when assembling or placing furniture. However, people consider these safety straps and their installation to be a nuisance and simply do not bother to install the safety mechanisms.

OBJECTS AND SUMMARY OF THE INVENTION

It is an object of at least one embodiment of the present invention to provide new and improved mechanisms for integrating or incorporating into pieces of furniture to prevent the furniture from tipping over.

It is yet another object of at least one embodiment of the present invention to provide a dresser that resists tipping when a top drawer of the dresser is open.

It is still another object of at least one embodiment of the invention to obviate the need for safety straps or other mechanisms when installing or placing furniture thereby eliminating the problem of lack of compliance with proper installation and placement directives.

It is still another object of at least one embodiment of the present invention to provide a dresser that resists tipping when the toddler physically engages an open bottom drawer of the dresser or reaching the upper region of the dresser and pulling (tipping) it forward.

Another object of at least one embodiment of the present invention is to provide a dresser that resists tipping even when the toddler climbs on or into a bottom drawer region of the dresser.

A piece of furniture such as a dresser having an anti-tipping mechanism in accordance with one embodiment of the invention includes a frame having a front facing surface and a rear facing surface, a rectangular drawer insertable into and partly removable from the frame and which includes a vertically oriented front panel, rectangular side panels, a horizontal lower panel and a vertically oriented rear panel, and front, non-adjustable supports and rear, non-adjustable supports for supporting the frame on a horizontal surface. The rear supports have a lower height than the front supports, relative to a plane passing through the piece of furniture and parallel to the horizontal surface on which the piece of furniture is supported. As such, a distance between a lowermost drawer and a rear of the frame is less than a distance between the lowermost drawer and a front of the frame when the lowermost drawer is fully inserted into the frame.

In one embodiment, the front and rear supports are provided by side panels of the frame having an angular slant at their bottom.

More than one drawer may be provided. As such, the drawers may be movable in a downward direction into the frame and not in a direction parallel to a horizontal plane on which the frame rests. However, it is also possible to construct the piece of furniture such that the drawers are movable in opposite directions parallel to the horizontal plane, e.g., inward in one direction and outward in the opposite direction. The taper of the frame to provide the angled insertion and removal is possible but not required.

The frame may include a top panel having an upper surface parallel to a horizontal plane on which the frame rests. It may also include side panels having upper edges with an angular slant at their top, and a top panel above the side panels and providing the upper surface and having a uniform thickness. A distance between an uppermost drawer and a front of the frame is less than a distance between the uppermost drawer and a rear of the frame when the uppermost drawer is fully inserted into the frame. Front and rear edges of the top panel may not be perpendicular to a lower surface of the top panel nor to top surfaces of the side panels. However, the frame can include a top panel that has a front edge portion having a smaller height than a rear edge portion.

In another embodiment, the frame includes a top panel having an upper surface slanting downward and not parallel to a horizontal plane on which the frame rests.

When the front and rear supports are legs, the rear legs are shorter than the front legs relative to a plane parallel to a horizontal plane on which the frame rests. It is possible in this embodiment that the frame includes a top panel having an upper surface slanting downward and not parallel to the horizontal plane on which the frame rests.

When the front and rear supports are casters, the rear casters are shorter than the front casters relative to a plane parallel to a horizontal plane on which the frame rests.

When the front and rear supports are rolling wheels, the rear rolling wheels are shorter than the front rolling wheels relative to a plane parallel to a horizontal plane on which the frame rests.

Another embodiment of a piece of furniture in accordance with the invention includes a frame having a front facing surface and a rearwardly-slanted facing surface having a lower edge closer to the front facing surface and an upper edge, and one or more drawers each insertable into and partly removable from the frame of which at least one includes a rearwardly-slanted front panel that has an upper edge closer to the rear surface than a lower edge. All of the drawers, when multiple drawers are present, may include the rearwardly-slanted front panel that has an upper edge closer to the rear surface than a lower edge. Each drawer can further include a lower horizontal support panel, opposite side panels having rearwardly slanted front and rear edges and upper and lower edges, and a rearwardly-slanted rear panel.

There can be casters below the frame for supporting the frame on an underlying horizontal surface. Casters at a rear of the frame have a smaller height than casters at a front of the frame to provide the frame with a rearward tilt. Two or more casters may be provided at the front of the frame and two or more casters provided at the rear of the frame.

There may be, in another embodiment, legs below the frame for supporting the frame on an underlying horizontal surface. The legs at a rear of the frame have a smaller height than the legs at a front of the frame to provide the frame with a rearward tilt. Two or more legs, e.g., solid-round legs, may be provided at the front of the frame and two or more such legs provided at the rear of the frame.

Another embodiment of a piece of furniture in accordance with the invention includes a frame having a front facing surface and a rear facing surface, drawers each insertable into and partly removable from the frame and including a front panel, side panels, a lower panel and a rear panel, and structure for supporting the frame on a horizontal surface such that the drawers are movable in a downward angular direction when moving into the frame and are movable in an upward angular direction when moving out of the frame. This structure may be different height legs, different height casters, different height rolling wheels, a frame with side panels having a slant, or even same size casters, legs, rolling wheels but mounted at different heights to the frame.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

In the embodiments disclosed herein, a dresser including a plurality of vertically spaced drawers is often used as an example of a piece of furniture in which an anti-tipping mechanism may be integrated or incorporated. The drawers often have the same width and are situated one on top of another. Their height and depth may vary. The anti-tipping mechanisms of the invention can be used on other types of furniture in addition to dressers and are not limited to use with only dressers. Also, the dressers may include one or more drawers in any of the sections therein.

Figure 1:
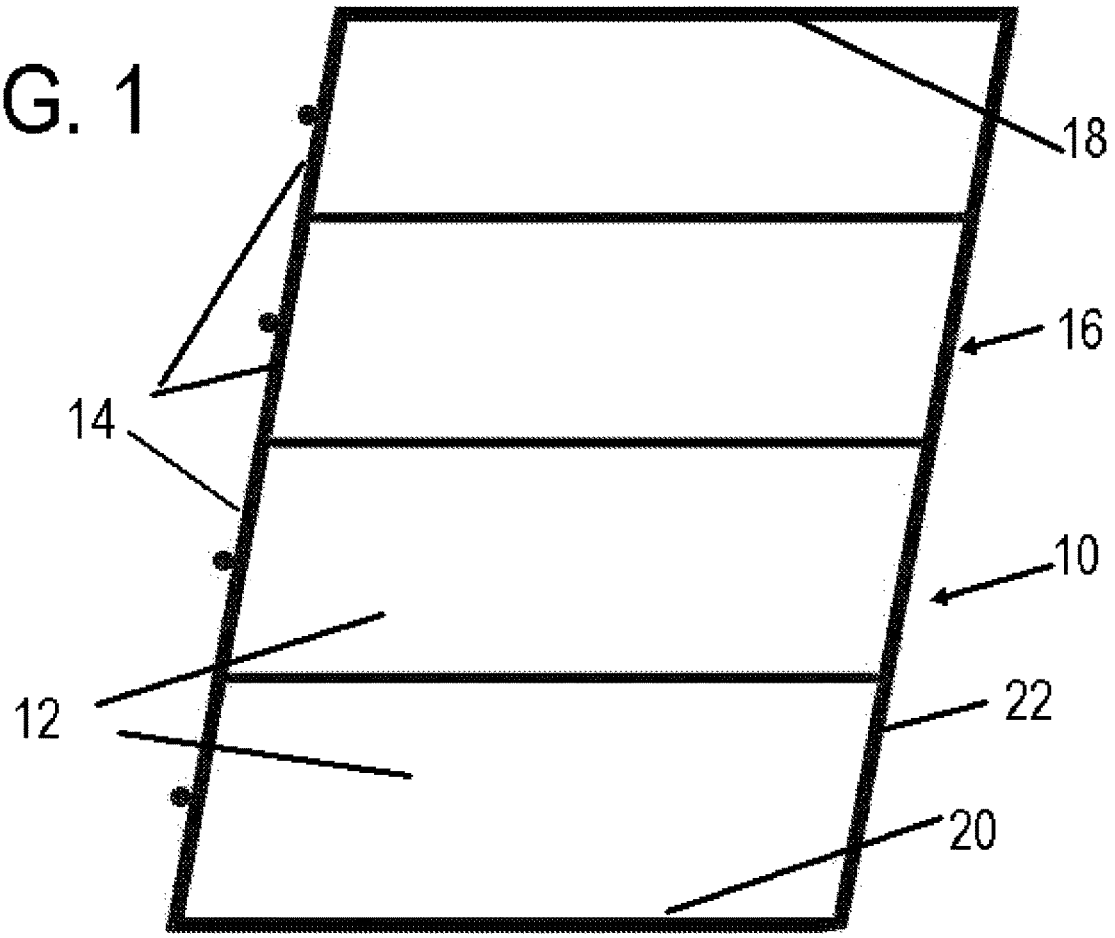
FIG. 1 is a side view of a dresser in accordance with the invention that provides anti-tipping properties.

FIG. 1 shows a dresser 10 with drawers 12 each including a rearwardly-slanted front panel 14, and a frame 16 of the dresser 10 that includes an upper panel 18 and a lower panel 20. The entire front surface of the dresser 10, formed primarily by the front surface of the front panels 14 is thus rearwardly slanted, which means that its lower edge is more forward than its upper edge.

Each drawer 12 does not have a rectangular shape. Rather, although the lower surface of each drawer 12, formed by a support panel, is horizontal and parallel to the floor or other surface below the dresser 10, the front panel and rear panel are rearwardly slanted. Each drawer 14 may also include opposite side panels that are also not rectangular in shape but rather with rearwardly slanted front and rear edges. The upper and lower edges of the side panels forming the drawers 14 are parallel to the floor or other surface below the dresser 10. Often, the lower surface of the dresser 10 will be parallel to the floor or other surface below the dresser 10, in which case, the lower panel and lower edges of the drawers 14 are parallel to the lower surface of the dresser 10.

The design of the drawers 14 is relatively simple, and most likely these drawers 14 will be provided with conventional, currently known, tracks or comparable sliding mechanisms to enable their movement relative to the frame 12. Such tracks and drawer designs are examples only, for this embodiment as well as the other embodiments disclosed herein, and are generally not intended to limit the scope and spirit of the invention. Unless limited to such, the drawer designs and tracks used in furniture in accordance with the invention may vary as can be conceived by those skilled in the art to which this invention pertains to any number of different configurations.

The rear facing surface 22 of the frame 16 of the dresser 10, behind the rear panels of the drawers 14, has a rearward slant and this surface may be one or more of the surfaces of each of two rear vertical supports on the opposed lateral sides of the frame 16 if present, a panel or board at the rear of the frame 16 that forms the rear of the dresser 10, and rear facing parts of side panels along the sides of the frame 16 of the dresser 10.

Figure 2:
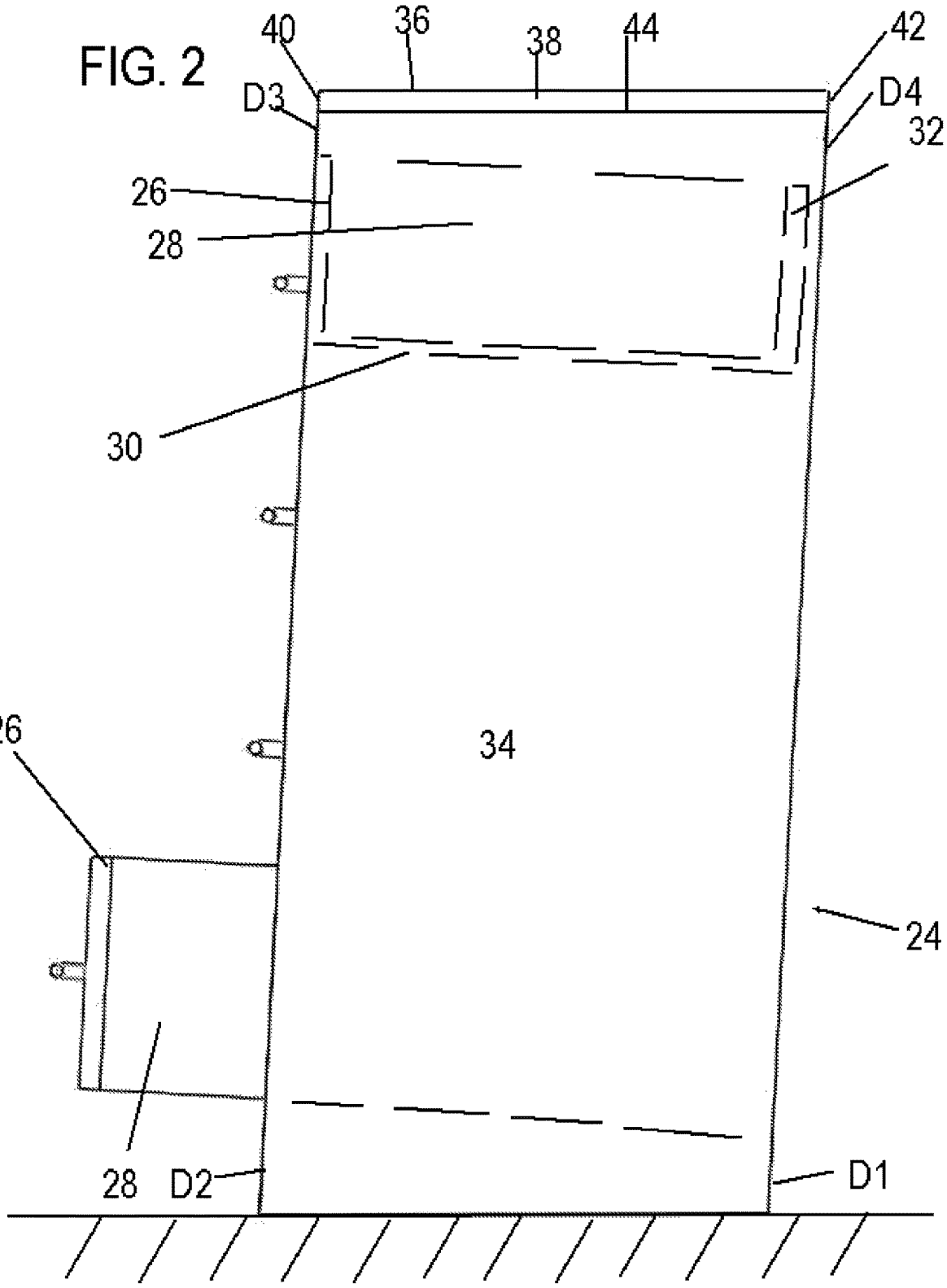
FIG. 2 is a side view of another embodiment of a dresser in accordance with the invention that provides anti-tipping properties.

FIG. 2 shows an embodiment of a dresser 24 wherein rectangular drawers 26 are provided. Each drawer 26 has a vertically oriented front panel 28, and preferably rectangular side panels 28, a flat, horizontal lower panel 30 and a vertically oriented rear panel 32. The drawers 26 are this rectangular when viewed from the side. Providing rectangular drawers is much more typical of furniture than the irregular parallelogram shaped drawers in FIG. 1.

To enable tip-resistance with rectangular drawers 26 however, dresser 24 is constructed with its rear support to have a smaller height than the front support. That is, the distance D1 between the lowermost drawer and the back of the dresser 24 is less than the distance D2 between the lowermost drawer and the front of the dresser 24, when the lowermost one of the drawers 26 is fully inserted into the dresser 24. This height differential may be achieved by forming the side panels 34 with an angular slant at their bottom. The lowermost one of the drawers 26 will therefore be inserted in a downward direction into the dresser, not in a direction parallel to the horizontal plane, and an upward, angular removal of the lowermost drawer from the dresser 24. By contrast, in conventional dressers, the drawers are movable back and forth in directions parallel to the horizontal surface on which they rest.

An important aspect of the dresser 24 is that the upper surface 36 of the dresser 24 is not slanted, but rather is parallel to the lower surface on which the dresser 24 rests. This is achieved in any number of ways. As shown, upper edges of the side panels 34 are constructed to be horizontal, i.e., with an angular slant at their top, and then a top panel 38 providing the upper surface 36 having a uniform thickness is situated on top of the side panels 34. As such, the distance D3 between the uppermost drawer and the front of the dresser 24 is less than the distance D4 between the uppermost drawer and the rear of the dresser 24, when the uppermost one of the drawers 26 is fully inserted into the dresser 24 and present entirely in the frame dresser 24. Front and rear edges 40, 42, respectively, of the top panel 38 are not perpendicular to the lower surface of the top panel 38 nor to top surfaces 44 of the side panels 34.

In the alternative, it is possible to construct the dresser with a top panel that has a front edge portion having a smaller height than the rear edge portion. This top panel will not have a rectangular cross-section, with parallel top and bottom surfaces but instead they will be at an acute angle relative to one another. Regardless of the construction of the dresser 24, the distance D3 between the uppermost drawer and the front of the dresser 24 will less be than the distance D4 between the uppermost drawer and the rear of the dresser 24, when the uppermost one of the drawers 26 is fully inserted into the dresser 24 and present entirely in the frame of the dresser 24. This will result in the uppermost of the drawers 26 requiring a downward, angular insertion into the dresser, not an insertion in a direction parallel to the horizontal plane, and a corresponding upward, angular removal of the drawer from the dresser 24.

Dresser 24 in FIG. 2 therefore differs from dresser 10 in FIG. 1 in that in dresser 10, the drawers 12 are movable in directions parallel to the horizontal plane on which the dresser 10 rests. However, to allow for this, the front panels of the dresser 10 must be slanted rearward toward their top and angled at an angle other than 90 degrees to the bottom panel of the drawer. By contrast, the front panels of the drawers 26 of dresser 24 are perpendicular to their bottom panel, but the drawers 26 do not move in directions parallel to the horizontal plane on which the dresser 10 rests. Rather, the drawers 26 move at an angle to this horizontal plane.

Figure 3:
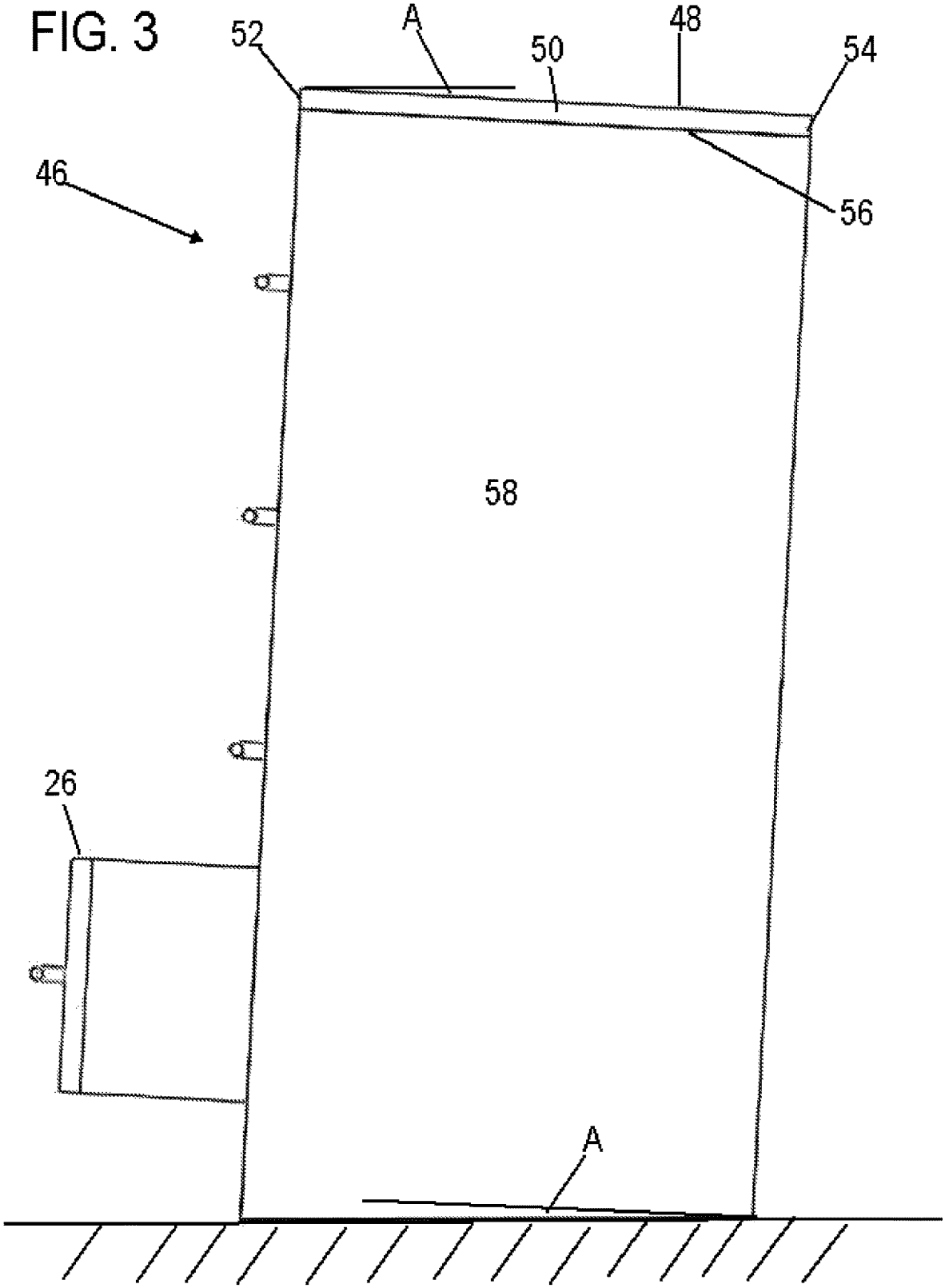
FIG. 3 is a side view of yet another embodiment of a dresser in accordance with the invention that provides anti-tipping properties.

FIG. 3 shows a dresser 46 similar to that shown in FIG. 2 except that the upper surface 48 of the top panel 50 is not horizontal, i.e., parallel to the horizontal plane formed by the support surface on which the dresser 46 rests, but rather is angled with a rearward slant. The angle A at which the upper surface 48 slants rearward may be the same angle of tilt or skew of the dresser 46. In this embodiment, the front and rear edges 52, 54, respectively, of the top panel 50 are perpendicular to the lower surface of the top panel 50 and to top surfaces 56 of side panels 58.

Figure 4:
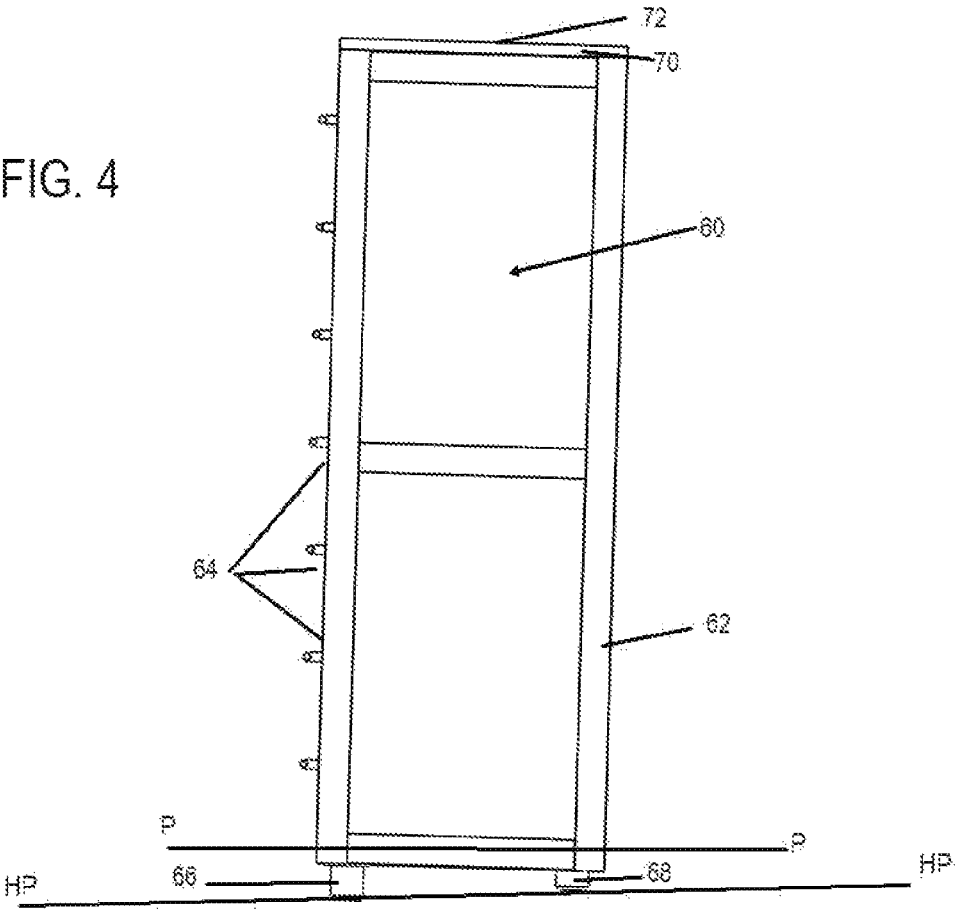
FIG. 4 is a side view of yet another embodiment of a dresser in accordance with the invention wherein the anti-tipping characteristic is provided by lower height rear supports, namely legs, relative to the front legs.

FIG. 4 is an embodiment of a dresser 60 including a frame 62 and a plurality of drawers 64 that are movable into and at least partly out of the frame 62. The construction of the frame 62 is not intended to limit this embodiment of the invention. Indeed, the dresser 60 can have different frames with various numbers and shapes of drawers, possibly without legs or casters. Movement of the drawers 64 out of the frame 62 via tracks or other comparable sliding mechanisms enables access to the interior space thereof. By way of example only, the dresser 60 includes two front legs 66 and two rear legs 68. Legs 66, 68 are attached to or incorporated into the frame 62 and thus it will be considered that the dresser 60 comprises legs 66, 68.

To provide tip-resistance, the rear legs 68 are shorter than the front legs 66. More generally, the lower surface of the rear legs 68 is spaced from a horizontal plane P, that is parallel to the horizontal plane HP defined by the surface on which the dresser 60 rests, a distance that is less than the distance between the lower surface of the front legs 66 and the same plane P. This distance may be as little as about 0.25 inches, but even such a small height differential causes the dresser 60 tilt rearward and aids in tip-resistance. A larger angle improves the tip-resistance, such a larger angle being obtained by increasing the distance-differential between the lower surface of the rear legs 68 to the plane P and the lower surface of the front legs 66 to the plane P. The greater the increase in the angle, the greater the resistance to tipping the dresser 60 forward. For example, by incorporating this ¼ differential in the legs 66, 68, it may be possible to alter a 50 pound weight that tips the straight dresser to become 52-55 pounds needed to tip it forward (the exact increase depends on mathematical calculations, e.g., the cosine of the angle). Further, visually it would not even be discernible that the dresser 60 is tipped backward, unless a round marble on its upper surface and it would roll backwards.

If the legs are attached to the frame 62 in a common horizontal plane, which is possible but not required, then the rear legs 68 would be shorter than the front legs 66. It is conceivable that the front and rear legs 66, 68, respectively, are the same height but the rear legs 68 are attached to the frame 62 at a location above the location at which the front legs 66 are attached to the frame 62.

If the dresser 60 is frameless, the longer legs would be attached to front edge portions of the dresser 60, e.g., one on each side, and shorter, rear legs would be attached to rear edge portions of the dresser 60, e.g., one on each side.

As a result of the height differential between the front and rear legs 66, 68, the front bottom of the dresser 60 is naturally fractionally projected forward of the front top. As the dresser 60 tips further back by reducing the height of the rear legs 68, naturally the bottom projects forward as the top leans back. By its very nature, the bottom of the dresser 60 is angled forward, causing the top of the dresser 60 to be angled backward. One positive aspect of this construction of the dresser 60 is that there is an improved resistance to urge the dresser to tip forward.

Upper surface 72 of the top panel 70 is not horizontal, i.e., parallel to the horizontal plane HP formed by the support surface on which the dresser 60 rests, but rather is angled with a rearward slant. Top panel 70 therefore may have a rectangular cross-section with parallel top and bottom surfaces, but this is not required. The angle at which the upper surface 72 slants rearward may be the same angle of tilt or skew of the dresser 60. In this embodiment, front and rear edges of the top panel 70 are perpendicular to the lower surface of the top panel 70 and to the top surfaces of the frame parts to which they are connected.

The front and rear supports of dresser 60 are not adjustable, nor are any of the other supports or frames providing the rearward slant of dressers or other pieces of furniture in the invention. In the prior art, there are attachments to furniture that enable adjustment of the furniture relative to the horizontal surface on which the furniture is placed to accommodate uneven floors and the like. However, in the invention, the supports are not adjustable nor is there any possibility to adjust the height of the front or rear of the furniture in the invention. The supports are integrated into, incorporated into and built-in to the frame of the furniture or the furniture itself. No adjustability is possible. The furniture is sold in this manner.

Figure 5:
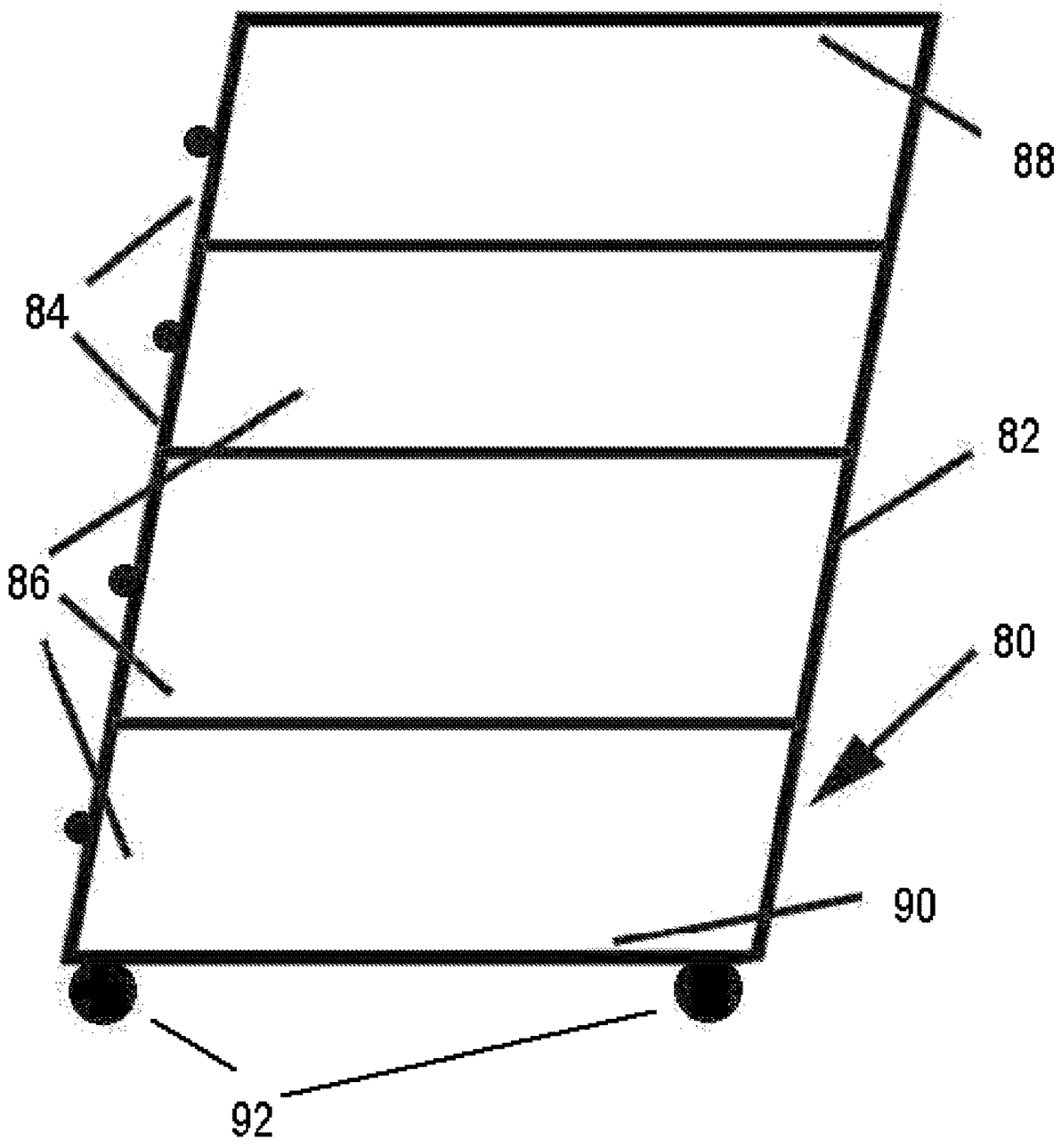
FIG. 5 is a side view of a dresser in accordance with the invention like the embodiment shown in FIG. 1 and wherein casters or fixed legs are attached to the bottom of the frame.

FIG. 5 shows an embodiment of a dresser 80 like dresser 10 shown in FIG. 1 except that it is mounted on casters or wheels 92 (although fixed legs, e.g., round-shaped legs, are also a possibility). Dresser 80 includes a frame 82 into which drawers 84 having interior spaces 86 are insertable and partly removable therefrom in directions parallel to the horizontal surface on which the dresser 80 rests. The dresser 80 also includes a top panel 88 and a bottom panel 90 to which the casters 92 are mounted. This embodiments provides anti-tip resistance by virtue of the rearward slant of the front and rear-facing surfaces of the dresser 80 (as discussed above with respect to dresser 10 in FIG. 1)

Figure 6:
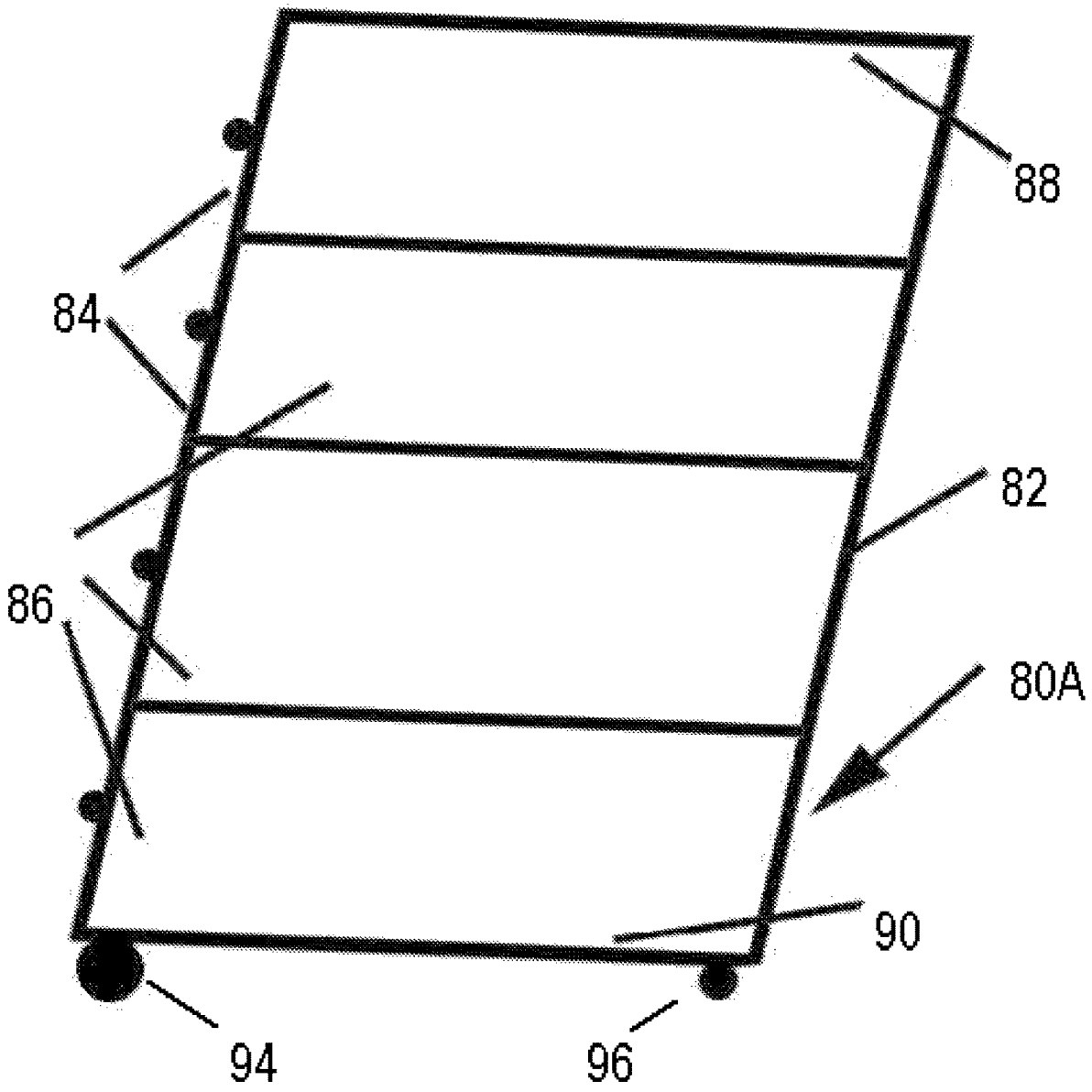
FIG. 6 is a side view of a dresser like the one shown in FIG. 5 and wherein the anti-tipping characteristic is provided by lower height rear supports, namely casters or fixed legs, relative to the front casters.

FIG. 6 shows a variant of dresser 80, designated 80A, in which the casters 94 and 96 have different sizes, namely, the casters 94 at the front of the dresser 80A on each side, are larger than the casters 96 at the rear of the dresser 80A on each side. This height differential further increases the tip-resistance. Instead of casters 94, 96, support legs, e.g., round-shaped solid legs, or wheels, may be used. Generally, any structure that elevates the portion of the furniture to which the structure is attached may be used, whether a solid leg, a rolling wheel, or a rotatable caster.

Thus, dresser 80A combines two aspects of embodiments of the invention, i.e., the construction of the dresser with a rearward slant and also with the lower, rear of the dresser being closed to the horizontal surface on which the dresser rests in comparison to the lower, front of the dresser. This latter aspect is provided by the different-height casters 94, 96.

It is possible to provide the same size casters or legs, but just adjust their mounting location to the frame 82, i.e., mount the rear casters 96 to a more vertical location on the frame 82 than the casters 94.

While these embodiments are directed to the serious, often fatal, accidents involving toddlers, they address all anti-tipping furniture issues that may arise, involving both toddlers and adults.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A piece of furniture, comprising:

a frame having a front facing surface and a rear facing surface;

a plurality of rectangular drawers each insertable into and partly removable from said frame, at least one of said drawers including a vertically oriented front panel, rectangular side panels, a horizontal lower panel and a vertically oriented rear panel; and front, non-adjustable supports and rear, non-adjustable supports for supporting said frame on a horizontal surface, said rear supports having a lower height than said front supports, whereby a distance between a lowermost one of said drawers and a rear of said frame is less than a distance between the lowermost one of said drawers and a front of said frame when the lowermost one of said drawers is present in said frame.

2. The piece of furniture of claim 1, wherein said front and rear supports are provided by side panels of said frame having an angular slant at their bottom.

3. The piece of furniture of claim 1, wherein said drawers are movable in a downward direction into said frame and not in a direction parallel to a horizontal plane on which said frame rests.

4. The piece of furniture of claim 1, wherein said frame includes a top panel having an upper surface parallel to a horizontal plane on which said frame rests.

5. The piece of furniture of claim 4, wherein said frame includes a top panel that has a front edge portion having a smaller height than a rear edge portion.

6. The piece of furniture of claim 4, wherein said frame includes side panels having upper edges with an angular slant at their top, and a top panel above said side panels and providing said upper surface and having a uniform thickness.

7. The piece of furniture of claim 6, wherein a distance between an uppermost one of said drawers and the front of said frame is less than a distance between the uppermost one of said drawers and the rear of said frame when the uppermost one of said drawers is present in said frame.

8. The piece of furniture of claim 6, wherein front and rear edges of said top panel are not perpendicular to a lower surface of said top panel nor to top surfaces of said side panels.

9. The piece of furniture of claim 1, wherein said frame includes a top panel having an upper surface slanting downward and not parallel to a horizontal plane on which said frame rests.

10. The piece of furniture of claim 1, wherein said front and rear supports are legs, said rear legs being shorter than said front legs relative to a plane parallel to a horizontal plane on which said frame rests.

11. The piece of furniture of claim 10, wherein said frame includes a top panel having an upper surface slanting downward and not parallel to the horizontal plane on which said frame rests.

12. The piece of furniture of claim 1, wherein said front and rear supports are casters or rolling wheels, said rear casters or rolling wheels being shorter than said front casters or rolling wheels relative to a plane parallel to a horizontal plane on which said frame rests.

13. The piece of furniture of claim 1, wherein said drawers are movable in a direction into said frame parallel to a horizontal plane on which said frame rests and movable in an opposite direction out of said frame.

14. A piece of furniture, comprising:

a frame having a front facing surface and a rearwardly-slanted facing surface having a lower edge closer to said front facing surface and an upper edge; and a plurality of drawers each insertable into and partly removable from said frame, at least one of said drawers including a rearwardly-slanted front panel that has an upper edge closer to said rear surface than a lower edge.

15. The piece of furniture of claim 14, wherein all of said drawers include the rearwardly-slanted front panel that has an upper edge closer to said rear surface than a lower edge.

16. The piece of furniture of claim 14, wherein each of said at least one of said drawers further includes a lower horizontal support panel, opposite side panels having rearwardly slanted front and rear edges and upper and lower edges, and a rearwardly-slanted rear panel.

17. The piece of furniture of claim 14, further comprising legs below said frame for supporting said frame on an underlying horizontal surface, two of said legs at a rear of said frame have a smaller height than two of said legs at a front of said frame to provide said frame with a rearward tilt.

18. The piece of furniture of claim 14, further comprising casters below said frame for supporting said frame on an underlying horizontal surface.

19. The piece of furniture of claim 18, wherein two of said casters at a rear of said frame have a smaller height than two of said casters at a front of said frame to provide said frame with a rearward tilt.

* * * * *